United States Patent [19]

Harrington

[11] Patent Number: 4,890,882

[45] Date of Patent: Jan. 2, 1990

[54] COLLAPSIBLE BEACH CHAIR

[76] Inventor: Christopher T. Harrington, 86 Spiral Rd., Holtsville, N.Y. 11742

[21] Appl. No.: 290,233

[22] Filed: Dec. 27, 1988

[51] Int. Cl.[4] ..... A47C 4/28

[52] U.S. Cl. ..... 297/45; 297/17; 297/440; 297/441

[58] Field of Search ..... 297/441, 440, 39, 40, 297/33, 42, 45, 17, 45; 5/432

[56] References Cited

U.S. PATENT DOCUMENTS

| | | | |
|---|---|---|---|
| 3,285,654 | 11/1966 | Cramer | 297/35 |
| 3,475,050 | 10/1969 | Leahy | 297/17 |
| 3,730,584 | 5/1973 | Uchida | 297/45 |
| 3,947,903 | 4/1976 | Merke | 5/111 |
| 4,577,901 | 3/1986 | Phillips | 297/17 |
| 4,614,377 | 9/1986 | Luo | 297/19 |
| 4,684,149 | 8/1987 | Meyer | 297/42 X |
| 4,784,436 | 11/1988 | Sutherland | 297/45 X |

FOREIGN PATENT DOCUMENTS

| | | | |
|---|---|---|---|
| 191118 | 9/1956 | Australia | 297/441 |
| 1096684 | 2/1955 | France | 297/39 |

*Primary Examiner*—James T. McCall

*Attorney, Agent, or Firm*—Leonard Belkin

[57] ABSTRACT

A collapsible beach chair having a seat made of parallel tubular members and a webbing stretched across to support the occupant, a pivoted back made of parallel tubular members with a webbing stretched across to support the back of the occupant, and identical end pieces to support both ends of the seat and the top of the back. Provision is made to permit the chair to be collapsed both transversely and by folding the back onto the seat after the end pieces are removed. The whole collapsed assembly will fit conveniently into a zippered bag with a shoulder strap.

5 Claims, 3 Drawing Sheets

COLLAPSIBLE BEACH CHAIR

BACKGROUND OF THE INVENTION

This invention relates to a collapsible beach chair and more particularly to a collapsible beach chair which when folded up for being carried makes a smaller and more convenient package than heretofore has been possible.

There are a large number and variety of collapsible beach chairs available for use by the public. Unfortunately, even when folded these chairs remain very bulky and difficult to carry or store and often are too heavy to call truly portable. Those chairs which are made less bulky are not comfortable for use or otherwise suffer a variety of drawbacks including buy not limited to lack of leg support.

A number of U.S. Patents are pertinent to but do not teach or suggest the present invention. These are: U.S. Pat. Nos. 3,285,654, 3,475,050, 3,947,903, 4,577,901 and U.S. Pat. No. 4,614,377.

SUMMARY OF THE INVENTION

The present invention is for a beach chair capable of being collapsed to a small and compact package which is convenient to assemble and transport.

In a preferred embodiment of this invention, there is provided a beach chair with arm rests, and most importantly is capable of being reduced to a svelte, slim lightweight package which can be conveniently carried as, for example, using a slim zippered bag with a shoulder strap/sling.

It is thus a principal object of this invention to provide a beach chair capable of being collapsed to a convenient package for being carried or transported.

Other objects and advantages of this invention will hereinafter become obvious from the following detailed description of a preferred embodiment of this invention.

DETAILED DESCRIPTION OF THE PREFERRED EMBODIMENT

Figure 1:
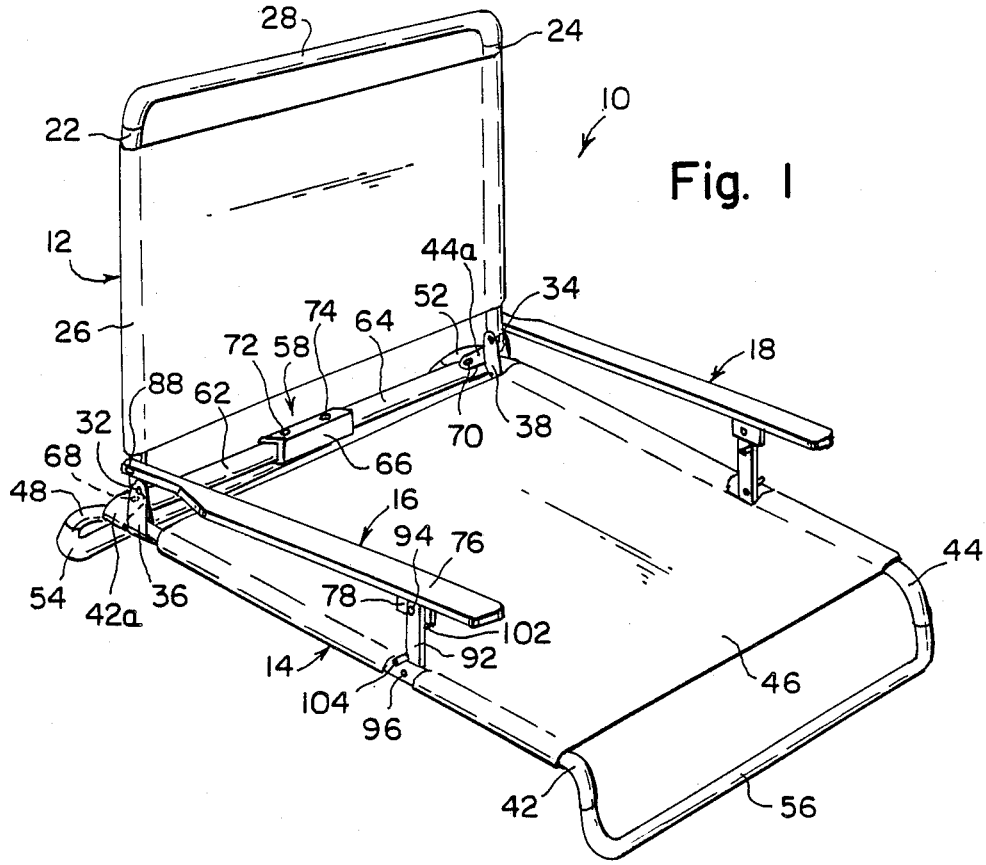
FIG. 1 is an isometric view of a beach chair incorporating the principles of this invention.
Figure 2:
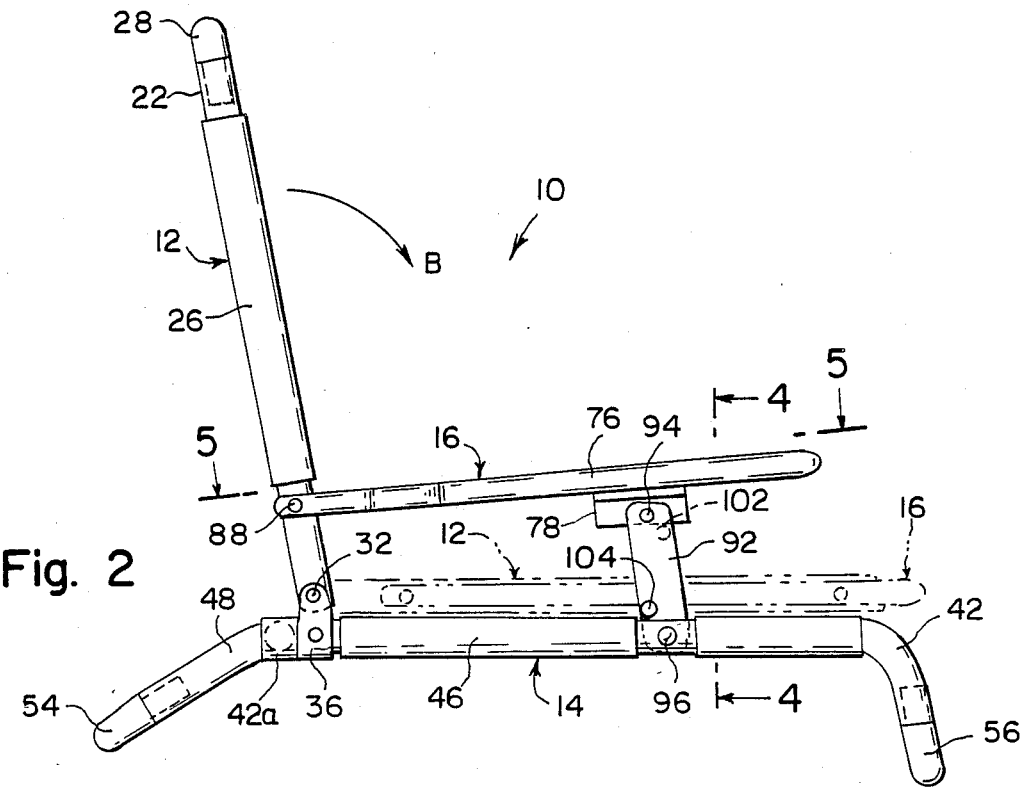
FIG. 2 is a side view of the chair shown in FIG. 1.

Referring to FIGS. 1 and 2, beach chair 10 incorporating the principles of this invention consists of a pivoted back 12, a seat 14, and a pair of arm rest assemblies 16 and 18.

Back 12 is made of a pair of elongated tubular members 22 and 24 spanned by a webbing 26 for supporting the back of the person sitting in chair 10. A removable end member 28 joins the ends of members 22 and 24 to hold the latter apart as shown in the figures when the chair 10 is in use. Member 28 has crimped ends for insertion in the open ends of tubular members 22 and 24 as illustrated.

The bottom ends of tubular members 22 and 24 are pivoted on pins 32 and 34 mounted in brackets 36 and 38 to permit members 22 and 24 to pivot in a manner to be described below.

Seat 14 is made from a pair of parallel tubular elements 42 and 44 spanned by a webbing 46 to support the person sitting in chair 10. The rear ends of elements 42 and 44 support brackets 36 and 38 as illustrated where riveted connections are provided so that brackets 36 and 38 remain integrally attached to elements 42 and 44, respectively.

As seen also in FIG. 2 more clearly, the rear ends of elements 42 and 44 terminate in a pair of transition sections 48 and 52 into which the ends of a removable rear foot support 54 are inserted as illustrated.

The front ends of tubular elements 42 and 44 are curved downwardly into which is inserted the ends of a removable front foot support 56. Removable end member 28 and rear and front foot supports 54 and 56 are identical and therefore interchangeable for ease of removal and replacement when the chair is to be reassembled for use. All of their ends are slightly crimped so as to be easily inserted into the tubular members 22, 24 and 42, 44 in the manner shown.

Figure 3:
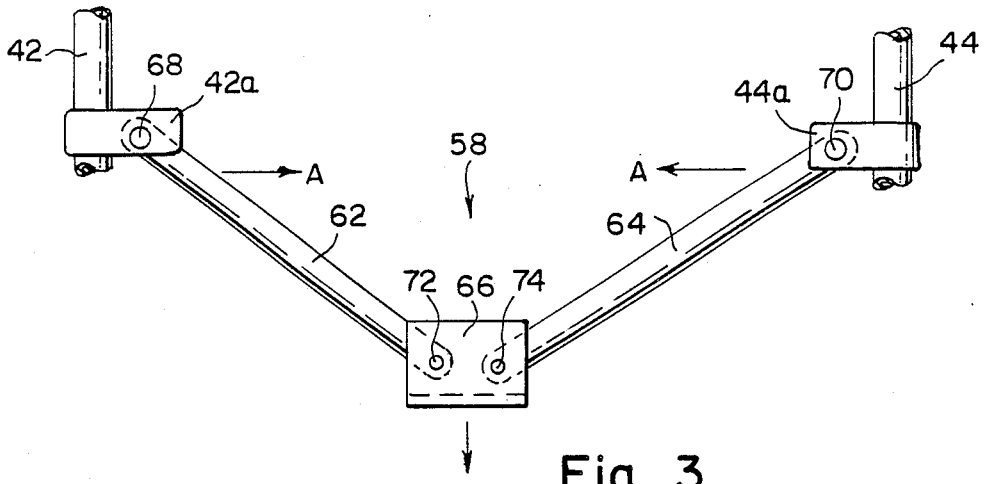
FIG. 3 is a plan view of the cross member shown in FIG. 1 partially retracted.

In order to be able to collapse chair 10 transversely when member 28 and supports 54 and 56 are removed, there is provided, as also seen in FIG. 3, a transverse collapsible assembly 58 consisting of a pair of arms 62 and 64 pivoted on members 42 and 44 with pins 68 and 70 in brackets **42*a* and 44*a*, respectively, as illustrated and terminating in a U-shaped member 66 on which is mounted a pair of pins 72 and 74 on which the ends of arms 62 and 64 are pivotally joined. To collapse chair 10, members 28, 54, and 56 are removed and member 66 is moved forward as shown by the arrow in FIG. 3 thereby folding arms 62 and 64** flat against each other.

Arm rest assemblies 16 and 18 are identical but mirror images of each other. The following description of arm rest assembly 16 would thus equally apply to arm rest assembly 18.

Figure 4:
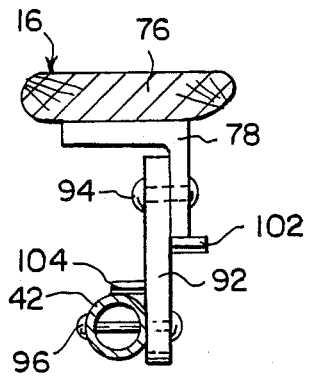
FIG. 4 is a view along 4—4 of FIG. 2.
Figure 5:
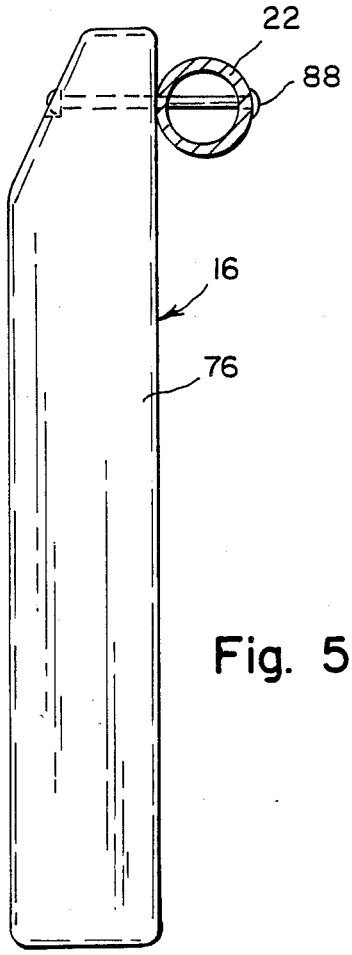
FIG. 5 is a view along 5—5 of FIG. 2.

As also seen in FIGS. 4 and 5, arm rest assembly 16 consists of an arm rest 76 mounted on one side of an angle 78 which may be held in place by screws (not shown) and/or adhesive. The rear end of arm rest 76 is joined in convenient fashion to tubular upright tubular member 22 by a pin 88, to permit pivoting in a manner to be described.

Angle 78 is supported by a strut 92 pivotally attached at its upper end by a pin 94 to angle 78 and through a pin 96 at its lower end to member 42. A pair of stops 102 and 104 limit the travel of strut 92 when it is in the raised position as seen in FIGS. 1 and 2. Arm rest 76 may be made of wood, plastic, or other suitable material.

Figure 6:
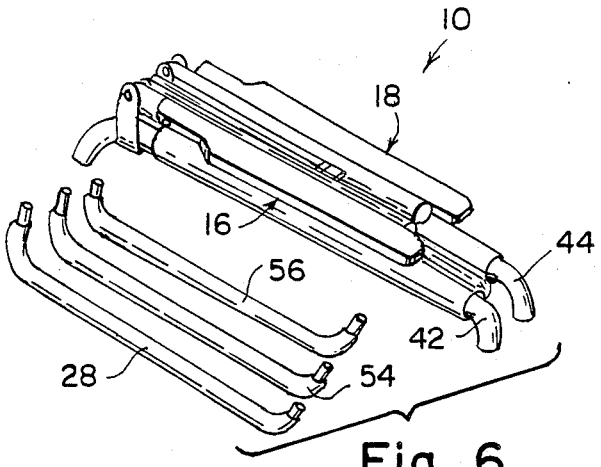
FIG. 6 is an isometric view of the chair collapsed for storage and/or carrying.
Figure 7:
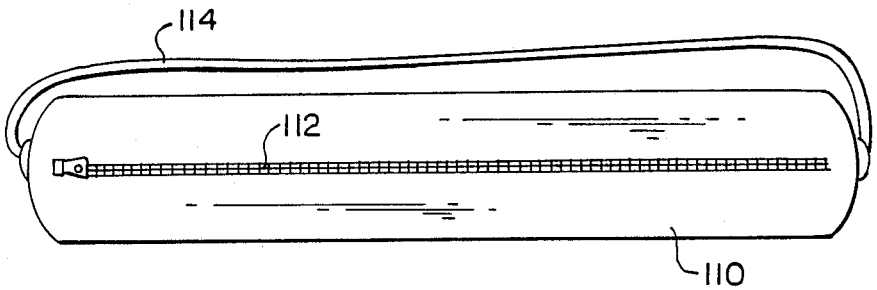
FIG. 7 is a side view of a bag or case for carrying the collapsed chair.

To collapse chair 10 shown in FIG. 1 in order to transport it conveniently, member 28 and foot supports 54 and 56 are removed, transverse support assembly 58 is folded as seen in FIG. 3 to collapse chair 10 transversely as shown by the arrow in FIG. 3, and back 12 is folded forwardly as shown by arrow B in FIG. 2 causing arm rest assemblies 16 and 18 to pivot forwardly, with the result that chair 10 is collapsed into a compact unit as seen in FIG. 6. The collapsed chair 10 with member 28 and supports 54 and 56 then can be placed into the compact bag 110 shown in FIG. 7 with a zipper 112 and a shoulder strap 114 for convenient carrying of the collapsed and disassembled chair 10, as seen in FIG. 8.

To assemble chair 10, the procedure described above is reversed.

It is thus seen that this invention provides a most unique beach chair which is comfortable when used, convenient when transported, and effortless to disassemble and re-assemble. The construction is likewise inexpensive and, while unadorned, is singularly effective at providing an application clearly capable of wide acceptance.

While only a certain preferred embodiment of this invention has been described it is understood that many variations of this invention are possible without departing from the principles of this invention as defined in the claims which follow.

What is claimed is:

1. A collapsible beach chair comprising:

a. seat means comprising a first pair of spaced, parallel tubular members and a cloth like material spanning said members to support a user in said chair;

b. folding means connected between said first pair of tubular members for maintaining said members apart and to permit said members to be collapsed together;

c. means removably attached to the front ends of said first pair of tubular members for supporting the front end of said seat means when said chair is in use and preventing said first pair of tubular members from collapsing toward each other;

d. means removably attached to the rear ends of said first pair of tubular members for supporting the rear end of said seat means when said chair is in use to prevent the collapse of said first pair of tubular members toward each other;

e. collapsible back means comprising a second pair of tubular members the bottom ends of which are pivotally connected to the rear ends of said first pair of tubular members rotatable between an upright position when said chair is in use and a forwardly dropped position parallel to said first pair of tubular members, a cloth like material spanning said second pair of parallel spaced tubular members for providing support to a user of said chair;

f. means removably attached to the top of said back means for preventing the second pair of tubular members from collapsing toward each other while said chair is in use;

g. arm rest means mounted above each of said first pair of tubular members having the rear ends thereof pivotally attached to said back means and the forward portions thereof pivotally attached to said first pair of tubular members so that said arm rest means is in a raised position while said chair is in use;

h. all of said removably attached means being identical and interchangeable;

i. said chair being collapsed for ease of storage and transportation by the removal of all of said removably attached means, collapsing of said folding means connected between said first pair of tubular members to permit said back means and seat means to collapse transversely and by having said back means move from its upright position to its forward dropped position, thereby forming a compact collapsed and disassembled beach chair;

j. the folding means connected between said first pair of tubular members of said seat means comprising a pair of arms pivoted at one end each respectively to one of said first pair of tubular members, the opposite ends of said arms being pivotally connected to and within a U-shaped member, said member being movable toward said seat means to permit each of said two pair of tubular members to collapse in a transverse direction toward each other so that said beach chair both collapses transversely and folds into a compact unit suitable for transport and storage; and k. each of said arm rest means comprising an angle, an arm rest mounted on one leg of said angle, and a vertically extending strut providing the pivoted attachment between said angle and the tubular member in said seat means.

2. A collapsible beach chair comprising:

a. seat means comprising a first pair of spaced, parallel tubular members and a cloth like material spanning said members to support a user in said chair;

b. folding means connected between said first pair of tubular members for maintaining said members apart and to permit said members to be collapsed together;

c. means removably attached to the front ends of said first pair of tubular members for supporting the front end of said seat means when said chair is in use and preventing said first pair of tubular members from collapsing toward each other;

d. means removably attached to the rear ends of said first pair of tubular members for supporting the rear end of said seat means when said chair is in use to prevent the collapse of said first pair of tubular members toward each other;

e. collapsible back means comprising a second pair of tubular members pivotally mounted on the rear ends of said first pair of tubular members rotatable between an upright position when said chair is in use and a forwardly dropped position parallel to said first pair of tubular members and cloth like material spanning said second pair of tubular members for providing support to a user of said chair;

f. means removably attached to the top of said back means for preventing the second pair of tubular members from collapsing toward each other while said chair is in use;

g. arm rest means mounted above each of said first pair of tubular members having the rear ends thereof pivotally attached to said back means and the forward portions thereof pivotally attached to said first pair of tubular members rearwardly and independent of said means for supporting the front end of said seat means so that said arm is in a raised position while said chair is in use;

h. all of said removably attached means being identical and interchangeable;

i. said chair being collapsed for ease of storage and transportation by the removal of all of said removably attached means, collapsing of said folding means connected between said first pair of tubular members to permit said back means and seat means to collapse transversley and by having said back means move from its upright position to its forward dropped position, thereby forming a compact collapsed and disassembled beach chair.

3. The beach chair of claim 2 in which the folding means connected between said first pair of tubular members of said seat means comprises a pair of arms pivoted at one end each respectively to one of said first pair of tubular members, the opposite ends of said arms being pivotally connected to and within a U-shaped member, said member being movable toward said heat means to permit each of said two pair of tubular members to collapse in a transverse direction toward each other so that said beach chair both collapses transversely and folds into a compact unit suitable for transport and storage.

4. The beach chair of claim 1 in which said strut is provided with stops to limit the travel of said strut.

5. The beach chair of claim 4 having a zippered carrying case with shoulder strap to carry said chair when collapsed including all of the removably attached means.

* * * * *